United States Patent [19]

West

[11] Patent Number: 4,721,932

[45] Date of Patent: Jan. 26, 1988

[54] CERAMIC TEM RESONATOR BANDPASS FILTERS WITH VARACTOR TUNING

[75] Inventor: James B. West, Cedar Rapids, Iowa

[73] Assignee: Rockwell International Corporation, El Segundo, Calif.

[21] Appl. No.: 19,399

[22] Filed: Feb. 25, 1987

[51] Int. Cl.[4] ..... H01P 1/205; H01P 7/04

[52] U.S. Cl. ..... 333/207; 333/202; 333/223; 333/263

[58] Field of Search ..... 333/202, 203, 205, 206, 333/207, 219, 222, 223, 204, 231, 235, 263, 245, 248, 209, 254, 256, 260, 164, 208, 210–212; 331/107 C

[56] References Cited

U.S. PATENT DOCUMENTS

| | | | |
|---|---|---|---|
| 3,869,681 | 3/1975 | Klein et al. | 331/107 C |
| 4,179,673 | 12/1979 | Nishikawa et al. | 333/204 |
| 4,268,809 | 5/1981 | Makimoto et al. | 333/202 |
| 4,410,868 | 10/1983 | Meguro et al. | 333/202 |
| 4,431,977 | 2/1984 | Sokola et al. | 333/206 |
| 4,523,162 | 6/1985 | Johnson | 333/202 |

OTHER PUBLICATIONS

Schaffner–"Design Tips for Coaxial-Cavity Varactor Multipliers"(An 159), Application Note, Motorola Inc. (Reprinted from Electronics, Printed Nov. 1965; pp. 3–10, Front Cover Page and Rear Cover Page.

"Comb-Line Bandpass Filters of Narrow or Moderate Bandwidth" by George L. Matthaei, Aug. 1963, *Microwave Journal*, pp. 82–91.

"Analysis and Composition of a New Microwave Filter Configuration with Inhomogeneous Dielectric Medium" by A. Fukasawa, *IEEE Trans. on Microwave Theory and Techniques*, vol. MTT-30, No. 9, Sep. 1982, pp. 1367–1375.

"Ceramic-Filled Resonator Cuts Costs of Radio-Telephone Filters" by T. Uwano, Jul. 14, 1983, *Electronics*, vol. 56:129–131.

*Microwave Filters Impedance Matching Networks and Coupling Structures* by G. L. Matthaei et al, McGraw Hill Book Co., NY, NY, 1964, Sections 8.13, and 8.14, and 12.01–12.07.

*Primary Examiner*—Marvin L. Nussbaum

*Attorney, Agent, or Firm*—Gregory G. Williams; M. Lee Murrah; H. Fredrick Hamann

[57] ABSTRACT

A ceramic TEM resonator bandpass filter with varactor tuning is disclosed. The varactor is located within the resonator holes of a ceramic TEM resonator filter, and is positioned within said holes immediately above the upper extent of the metal plating forming the resonator in said resonator holes. The placement of the varactor in such a manner reduces the interference caused by the varactor in the interresonator coupling. A new apparatus for positioning the varactor within the resonator hole is disclosed and basically includes a conductive rod which at its top end receives the varactor.

5 Claims, 4 Drawing Figures

CERAMIC TEM RESONATOR BANDPASS FILTERS WITH VARACTOR TUNING

BACKGROUND OF THE INVENTION

Cross-reference to Related Applications

This application relates to the subject matter of a co-pending application by the same inventor entitled "Ceramic TEM Bandstop Filter", filed on even date herewith and assigned to the same assignee, the Ser. No. of which is 19,400; and to a co-pending application by James B. West and James C. Cozzie, entitled "Launcher-less and Lumped Capacitor-less Ceramic Comb-line Filters", filed on even date herewith and assigned to the same assignee, the Ser. No. of which is 19,398; and the subject matter of both of those applications is hereby incorporated by reference.

Field of the Invention

The present invention generally relates to microwave RF filters, and more particularly, is concerned with ceramic TEM resonator bandpass filters with varactor tuning.

In recent years, ceramic filters have enjoyed an increase in use. Ceramic transverse electromagnetic (TEM) resonator bandpass filters find many uses throughout the microwave RF industry, with uses as low loss preselector bandpass filters being exemplary of the countless other applications. In such applications, it is often much desired to allow only a certain range of frequencies, usually a narrow bandpass, to continue from the broadband of an antenna to the narrow band of a typical microwave receiver, while concomitantly having a very small degree of signal strength loss in the passband.

One method of manufacturing ceramic TEM resonator filters has been to bore a series of holes through a ceramic dielectric block, then to place a metal coating on all the surfaces of the ceramic block including the interior of the bore holes, excepting only the top surface of the ceramic block. On this top surface, a lumped capacitor is formed by a metalization process for each of the TEM resonator holes. These lumped capacitors provide the capacitance typically associated with each resonator in TEM resonator filters. In certain applications, it is desirable to be able to quickly vary the capacitance value of these capacitors in order to quickly vary the resonant frequency of each resonator and thereby quickly vary the bandpass frequency of the filter. In one implementation, these lumped capacitors were replaced by varactor diodes which were similarly formed on the top surface of the ceramic block.

However, certain disadvantages occur in such an implementation. The major disadvantage is that the inter-resonator coupling is disturbed by the presence of the varactor located on the top surface of the ceramic block. The varactor causes EM field disturbances within the ceramic structure which in turn create problems in tuning the filter to the desired frequency.

Consequently, a need exists for improvements in the varactor tuned ceramic TEM resonator bandpass filters which will result in decreased varactor caused EM field disturbances within the ceramic which influence inter-resonator coupling.

SUMMARY OF THE INVENTION

It is an object of the present invention to provide a varactor tuned ceramic TEM resonator bandpass filter with improved inter-resonator coupling.

It is a feature of the present invention to include a varactor diode disposed with the resonator bore hole.

It is an advantage of the present invention to achieve a decrease in varactor-generated EM field disturbances interfering with inter-resonator coupling.

The present invention provides a varactor tuned TEM resonator ceramic bandpass filter designed to satisfy the aforementioned needs, provide the previously-propounded objects, include the above-described features, and produce the earlier-articulated advantages. The invention embodies a ceramic TEM resonator bandpass filter which is varactor tuned with an implementation such that the varactor-generated EM field disturbances which interfere with the inter-resonator coupling are diminished.

Accordingly, the present invention relates to a varactor tuned TEM resonator ceramic bandpass filter having the varactors disposed within the TEM resonator holes but still above the metal plating within the resonator holes.

DETAILED DESCRIPTION OF A PREFERRED EMBODIMENT

Figure 1:
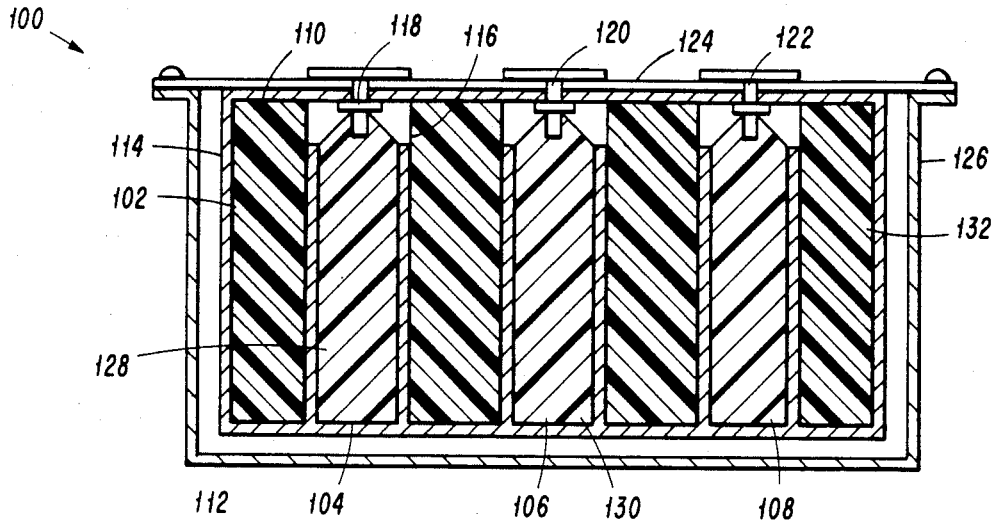
FIG. 1 is a cross-sectional view of a three resonator ceramic bandpass filter of this invention which employs varactor diodes with each resonator together with a typical environment.

Now referring to FIG. 1, there is shown an apparatus, generally designated 100, which includes a ceramic varactor tuned bandpass filter block 102, having a first resonator hole 104, a second resonator hole 106, and a third resonator hole 108. These resonator holes are used in part to provide the resonators typically associated included in TEM resonators and are shown with the below-described retainer tubes positioned therein. Each resonator hole is constructed in a fashion similar to resonator hole 104, which is constructed by boring a hole in the ceramic block 102 from its top surface 110 to its bottom surface 112. A conductive material plating 114, preferably a copper thick film, is applied to all surfaces of the ceramic block 102 including the sides of bore holes 104, 106 and 108, except that the plating inside the holes does not extend completely from the bottom surface 112 to the top surface 110. The dimensions of the thickness of the plating 114 is exaggerated in the drawings for purposes of illustration. In actuality, the thickness of the plating is very small in comparison to the other filter dimensions and a thickness of several skin depths is preferred. An unplated zone 116 appears at the top of each resonator hole. Within these zones are situated the varactors 118, 120 and 122. When the varactor 118 is placed upright in zone 116, the varactor diodes interfere less with the inter-resonator coupling EM fields. This design is preferred over merely placing the varactors directly on the top surface of typical ceramic filters having full-length plated resonators, because in such designs the varactors are closer and in the same plane as the ceramic, and therefore interfere with the inter-resonator coupling to a much greater extent. A typical circuit board 124 is shown engaging the filter 102 which is enclosed in a metal piece 126. This circuit board could also be soldered to the bottom side of circuit board 124. The varactors 118, 120 and 122 are shown engaging the varactor diode retaining tubes 128, 130 and 132, respectively. These tubes allow for easy and positive varactor placement and can be understood more fully under closer inspection, as described in the following figures.

Figure 2:
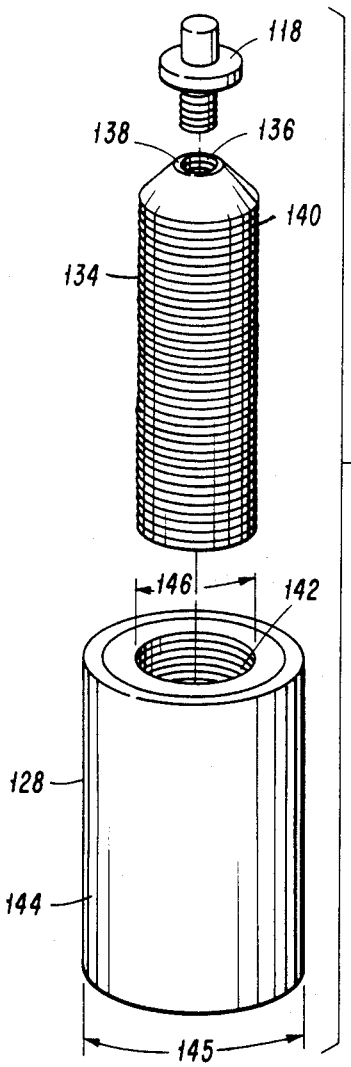
FIG. 2 is an enlarged, exploded, perspective view of the diode, post, and diode-retaining tube of this invention.

Now referring to FIG. 2, there is shown an enlarged, exploded view of a representative resonator structure which includes varactor 118. The type, style and design of varactor 118 is variable, and depends upon the particular desired characteristics of the filter, so long as the chosen varactor is capable of being inserted into the top of post 134 which has diode receiving threads 136 therein at its top end 138. Post 134 is essentially a rod having external threads 140 with a partially conical top end 138 with an internal cavity 136 therein. The post 134 can be made of any electrically conductive material, but silver plated beryllium copper is preferred. The external threads 140 are for engaging with the internal threads 142 of varactor diode retaining tube 128, which is fashioned from similar material as post 134. Tube 128 is essentially a cylinder with threads 142 on its inside surface, and having a relatively smooth exterior surface 144. The diameter 145 of the cylinder exterior is determined by the resonator hole 104 diameter while the internal opening diameter 146 is a function of the post 134 diameter. The height of tube 128 is preferably equal to the height of the metal plating 114 within hole 104. The tube 128 can be bonded to the plating 114 in hole 104 by any means which provides for electrical connection between the plating 114 and the tube 128, while also providing structural attachment therebetween. A solder joint or silver epoxy are the preferred bonding techniques. When the tube 128 is structurally bound to plating 114, the post 134 and attached varactor 118 can be manipulated upwards or downwards as desired for completing the mechanical and electrical joint.

Figure 3:
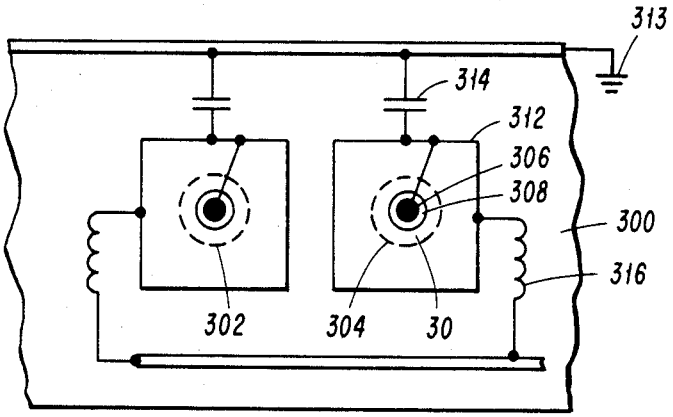
FIG. 3 is a schematic top view of the filter of this invention together with a typical circuit board.

Now referring to FIG. 3, there is shown a schematic top view of the filter of the present invention together with a typical circuitry environment. There are shown two resonators 302 and 304 of a multi-resonator filter generally designated 300. Resonator 304 is shown having a varactor 306 situated atop the diode retaining tube 308 which is inserted into resonator 304 and is in contact with plating 310. One terminal of varactor 306 is electrically connected to trace 312, which would typically be formed on the circuit board used with filter 300. Resonator 302 is constructed similar to resonator 304. Trace 312 is connected with the reference voltage 313 by an RF short through capacitor 314. Trace 312 is further connected to a variable voltage source by an RF choke 316. RF choke 316 can also be a printed ¼ wavelength transmission line. The invention may be more clearly understood by viewing a schematic electrical equivalent of this invention.

Figure 4:
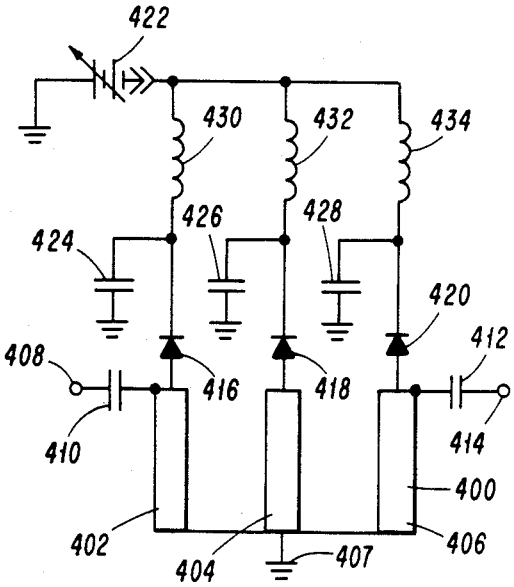
FIG. 4 is a schematic electronic equivalent diagram of a preferred embodiment of this invention.

Now referring to FIG. 4, there is shown such a schematic electrical equivalent of the filter of this invention together with a typical circuitry environment. There is shown a three-TEM resonator filter generally designated 400, having a first TEM resonator 402, a second TEM resonator 404, and a third TEM resonator 406. Resonators 402, 404 and 406 have a common reference voltage at 407. There is shown a signal input 408 and an input launching capacitor 410 which provides the necessary capacitive coupling to first TEM resonator 402. There is also shown an output launching capacitor 412, which provides the necessary capacitive coupling to couple signal output 414 to third TEM resonator 406. Connected to each of resonators 402, 404 and 406 are varactor diodes 416, 418 and 420, respectively. The varactor regulating voltage is equally provided to varactors 416, 418 and 420 by variable voltage source 422. In order to isolate varactor regulating voltage source 422 from unwanted RF signals, varactors 416, 418 and 420 are provided with an RF open or choke to the variable voltage source 422 by inductors 430, 432 and 434, respectively. The RF ground for resonators 402, 404, and 407 are provided by capacitors 424, 426 and 428, respectively.

In operation, a signal is input through signal input 408 and capacitively coupled to the varactor tuned ceramic bandpass filter 400 by launching capacitor 410. The pass frequency of filter 400 is variable depending upon the voltage supplied by varactor regulating variable voltage supply 422 to the varactors 416, 418 and 420 which varies the varactor capacitance and the resonant frequency of each resonator. The filtered signal is capacitively coupled to its outside environment through signal output 414 by output launching capacitor 412. In summary, the frequency which passes from input 408 through filter 400 and out of output 414 is controlled by regulating the voltage supply 422.

It is thought that the filter of the present invention, and many of its attendant advantages will be understood from the foregoing description, and it will be apparent that various changes may be made in the form, construction, and arrangement of the parts thereof without departing from the spirit and scope of the invention, or sacrificing all of its material advantages, the form hereinbefore described being merely a preferred embodiment thereof.

I claim:

1. An improved varactor tuned ceramic TEM resonator bandpass filter of the type having a metallic plated ceramic block with extending therethrough metallic plated resonator bore holes, each having a top end and a bottom end, wherein the improvement comprises a varactor diode fixed within an unplated portion of a resonator bore hole at its top end.

2. The filter of claim 1 further comprising a diode retaining tube for insertion within and in contact with the plated portion of a resonator bore hole which is capable of retaining a varactor diode.

3. An apparatus comprising:

a ceramic block having a top side, a bottom side and a plurality of bore holes extending from said top side through said ceramic block to said bottom side, said ceramic block being completely covered by an electrically conductive material on all surfaces including the sides of said bore holes at said bottom surface and excluding the sides of said bore holes adjacent said top surface;

a plurality of varactor diodes located one in each of said plurality of bore holes;

means for supporting and retaining said varactor diodes in said bore holes; and means for electrically connecting said varactor diodes with said conductive material plating within said bore holes at said bottom surface.

4. An apparatus of claim 3 wherein said means for retaining and supporting said varactors in said bore holes further comprises a cylindrical varactor retaining tube, for insertion within said bore holes, and for electrically contacting said conductive material coating within said bore holes at said bottom surface, said retaining tube having a top end and a bottom end, said varactor being retained by and supported by said retaining tube at said top end.

5. A method for constructing a varactor tuned ceramic TEM resonator bandpass filter comprising the steps of:

a. boring a plurality of holes through a ceramic block;
b. coating the ceramic block with a layer of conductive material including the sides of said bore holes;
c. removing the conductive material plating at the top of all of said plurality of bore holes;
d. positioning a varactor diode within the area of said bore holes with the conductive material coating removed; and
e. electrically connecting the varactor diode with the conductive coating remaining in said bore holes.

* * * * *